US009947222B2

(12) United States Patent
Bouzid et al.

(10) Patent No.: US 9,947,222 B2
(45) Date of Patent: Apr. 17, 2018

(54) ROAD TRAFFIC OPTIMIZATION SYSTEM

(71) Applicant: Alcatel Lucent, Boulogne Billancourt (FR)

(72) Inventors: Makram Bouzid, Nozay (FR); Armen Aghasaryan, Nozay (FR); Stephane Betge-Brezetz, Nozay (FR); Sophie Piekarec, Nozay (FR)

(73) Assignee: Alcatel Lucent, Boulogne-Billancourt (FR)

( * ) Notice: Subject to any disclaimer, the term of this patent is extended or adjusted under 35 U.S.C. 154(b) by 0 days.

(21) Appl. No.: 14/355,648

(22) PCT Filed: Sep. 27, 2012

(86) PCT No.: PCT/EP2012/069112

§ 371 (c)(1),
(2) Date: May 1, 2014

(87) PCT Pub. No.: WO2013/064316

PCT Pub. Date: May 10, 2013

(65) Prior Publication Data

US 2014/0303888 A1 Oct. 9, 2014

(30) Foreign Application Priority Data

Nov. 2, 2011 (FR) ..... 11 59904

(51) Int. Cl.
*G08G 1/0968* (2006.01)

(52) U.S. Cl.
CPC ... *G08G 1/096816* (2013.01); *G08G 1/09685* (2013.01)

(58) Field of Classification Search
CPC .. G01C 21/3453; G01C 21/3691; G08G 1/09; G08G 1/045; G08G 1/096811; G08G 1/096838
See application file for complete search history.

(56) References Cited

U.S. PATENT DOCUMENTS 5,610,821 A * 3/1997 Gazis et al. ..... 455/456.5
5,933,100 A 8/1999 Golding
(Continued)

FOREIGN PATENT DOCUMENTS

CN 1975801 A 6/2007
CN 101751794 A 6/2010
(Continued)

OTHER PUBLICATIONS

International Search Report for PCT/EP2012/069112 dated Dec. 6, 2012.

*Primary Examiner* — Thomas Ingram
(74) *Attorney, Agent, or Firm* — Fay Sharpe, LLP

(57) ABSTRACT

To optimize road traffic within an application server (SA) providing itineraries recommended to users connected to said application server from communication terminals (TC), each recommended itinerary being provided to a user based on a profile of the user containing the departure date or arrival date, the departure location and the arrival location, the application server compares the itineraries recommended to users whose indicated departure date belongs to a given interval time, produces a set of users whose corresponding recommended itineraries have at least one itinerary segment of given length in common, and modifies an itinerary recommended to at least one user who belongs to said set of users.

10 Claims, 2 Drawing Sheets

(56) References Cited

U.S. PATENT DOCUMENTS

Figure 1:
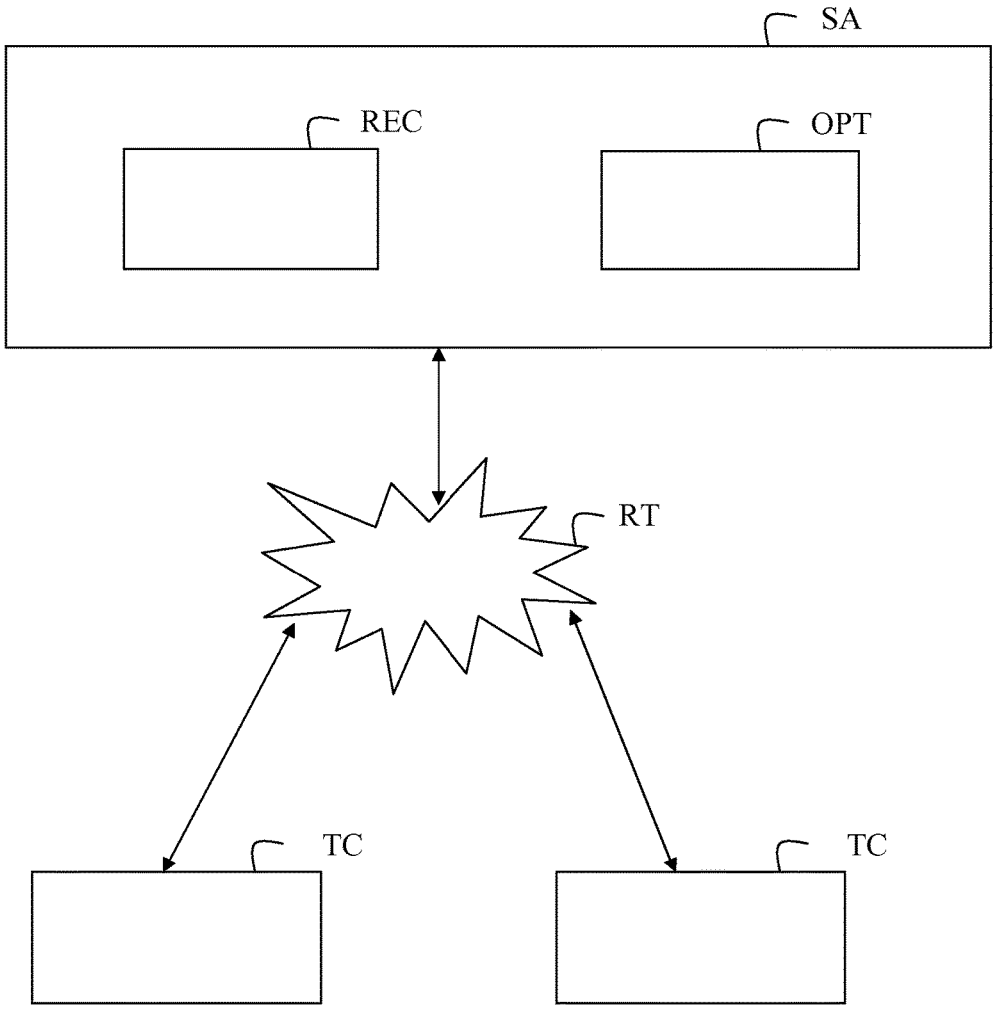

| | | | | |
|---|---|---|---|---|
| 2005/0021225 | A1* | 1/2005 | Kantarjiev et al. | 701/204 |
| 2006/0171308 | A1* | 8/2006 | Jung et al. | 370/229 |
| 2008/0004794 | A1* | 1/2008 | Horvitz | 701/200 |
| 2008/0234921 | A1* | 9/2008 | Groenhuijzen et al. | 701/118 |
| 2009/0204320 | A1* | 8/2009 | Shaffer et al. | 701/202 |
| 2012/0226434 | A1* | 9/2012 | Chiu | 701/117 |
| 2015/0051823 | A1* | 2/2015 | Joglekar | 701/118 |

FOREIGN PATENT DOCUMENTS

| | | | | |
|---|---|---|---|---|
| EP | 1067364 | A1 * | 1/2001 | G01C 21/26 |
| JP | 2002-83244 | A | 3/2002 | |
| JP | 2002-99982 | A | 4/2002 | |
| JP | 2003-308597 | A | 10/2003 | |
| JP | 2004-21503 | A | 1/2004 | |
| JP | 2006-78294 | A | 3/2006 | |
| JP | 2008-128938 | A | 6/2008 | |
| WO | 01/88480 | A1 | 11/2001 | |
| WO | WO 01/88480 | A1 | 11/2001 | |

* cited by examiner

ROAD TRAFFIC OPTIMIZATION SYSTEM

The present invention relates to a road traffic optimization system.

Currently, the road traffic in metropolitan areas is becoming increasingly congested. There is therefore a need to assist users in choosing the right itinerary and right moment to leave, taking into account their constraints and their preferences.

Current itinerary recommendation tools only look at the state of road traffic, and recommend itineraries that avoid congested road portions.

To remedy the aforementioned drawbacks, a method for optimizing road traffic within an application server providing recommended itineraries to users connected to said application server from communication terminals, each recommended itinerary being provided to a user based on a user profile containing the departure or arrival date, and the departure and arrival location, comprises the following steps within the application server:

comparing the itineraries recommended to users whose starting date belongs to a given interval of time, producing a set of users whose compared recommended itineraries have at least one itinerary segment of given length in common, and modifying an itinerary recommended to at least one user belonging to said set of users.

Advantageously, the invention makes it possible to make road traffic more fluid by suggesting different itineraries or different departure dates to the users, while fulfilling their preferences and constraints. For example, in an exceptional situation in which heavy snow is falling, users who want to know whether they should go home or stay at work can be assisted regarding the right itinerary to take or the right moment to leave, in order to avoid bottlenecks that are often created when many people are on the same roads at the same time.

According to another feature of the invention, said itinerary segment may additionally have the feature of comprising portions of roads that have a risk of being congested with road traffic. Furthermore, potential congestions of road segments may be identified after the users are grouped.

According to another feature of the invention, said itinerary segment may be determined based on information retrieved by the application server regarding the state of road traffic and the state of the roads.

According to another feature of the invention, said set of users may contain a minimum number of users whose compared recommended itineraries have an itineraries segment with minimum length in common.

According to another feature of the invention, the recommended itinerary may be modified by changing the starting date or by changing at least one segment of the itinerary.

According to another feature of the invention, the recommended itinerary may be modified based on preferences and restrictions related to the user's profile.

According to another feature of the invention, the itineraries recommended to the users may be updated by the application server based on at least one actual departure date indicated by a user.

The invention also pertains to an application server for optimizing road traffic providing recommended itineraries to users connected to said application server from communication terminals, each recommended itinerary being provided to a user based on a profile of the user containing the departure date or arrival date, the departure location or arrival location, the application server comprising:

means for comparing the itineraries recommended to the users whose departure date belongs to a given interval of time, means for producing a set of users whose compared recommended itineraries have at least one itinerary segment of given length in common, and means for modifying an itinerary recommended to at least one user belonging to said set of users.

The invention additionally pertains to a computer program capable of being implemented within a server or within a network of servers within a cloud computing environment, said program comprising instructions which, when the program is executed within said server, carry out the steps of the inventive method.

Figure 2:
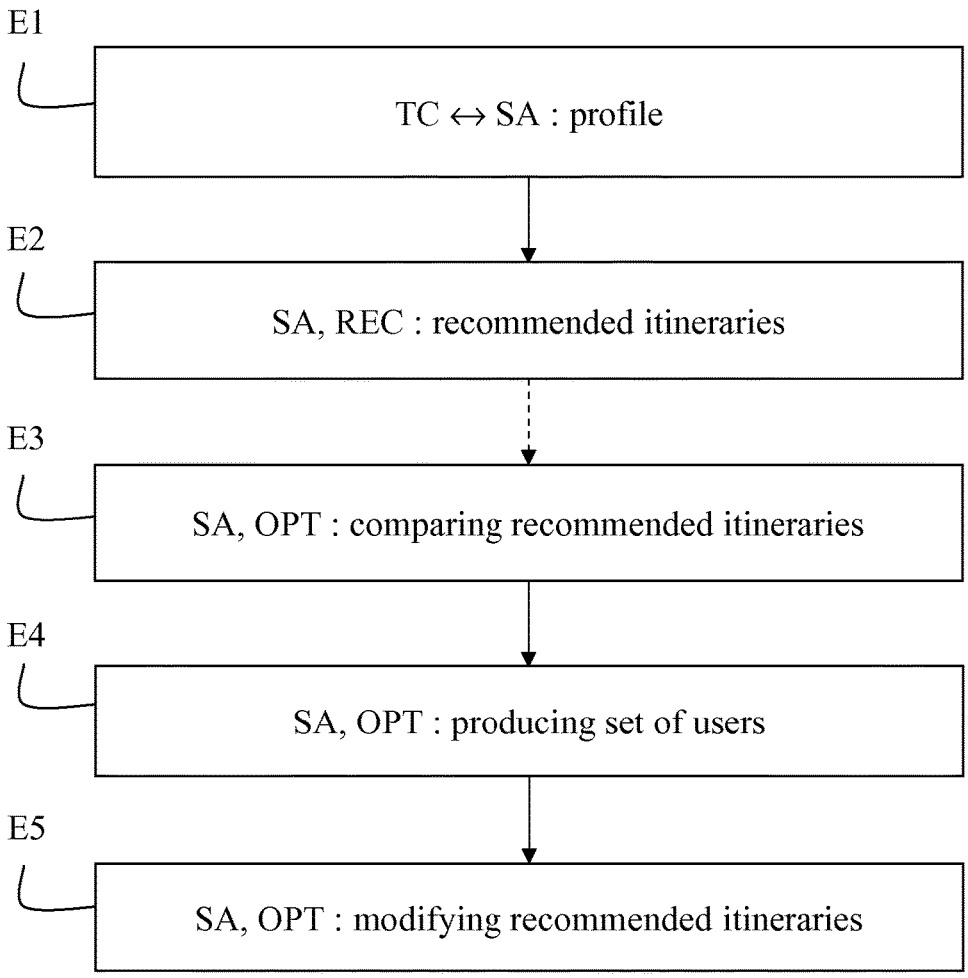

The present invention and the benefits thereof shall be better understood upon examining the description below, which makes reference to the attached figures, in which:

FIG. 1 is a schematic block diagram of a communication system according to one embodiment of the invention, FIG. 2 is an algorithm of a method for optimizing road traffic according to one embodiment of the invention.

With reference to FIG. 1, a communication system according to the invention comprises an application server SA and at least one communication terminal TC, capable of communicating with one another through a telecommunication network RT.

The telecommunication network RT may be a wired or wireless network, or a combination of wired and wireless networks.

In one example, the telecommunications network RT is a high-speed IP ("Internet Protocol") packet network, such as the Internet or an intranet.

In another example, the telecommunications network RT is an ATM ("Asynchronous Transfer Mode") or TDM ("Time Division Multiplexing") network or a private network specific to a company supporting a proprietary protocol.

A communication terminal TC of a user is connected to the application server SA over the telecommunications network RT.

In one example, a communication terminal is a personal computer directly linked by modem to an xDSL ("Digital Subscriber Line") or ISDN ("Integrated Services Digital Network") link connected to the telecommunication network RT.

In another example, a communication terminal is a mobile cellular radiocommunication terminal, linked by a radiocommunication channel to the telecommunication network, for example of the GSM ("Global System for Mobile communications") or UMTS ("Universal Mobile Telecommunications System") type, potentially using the protocol HSDPA ("High Speed Downlink Packet Access").

In another example, a communication terminal comprises an electronic telecommunication device or object that may be a personal digital assistant (PDA) or a smartphone, capable of being connected to an antenna on a public wireless local area network WLAN, a network using the 802.1x standard, or a wide area network using the WIMAX ("World wide Interoperability Microwave Access") protocol, connected to the telecommunication network.

The application server SA is a server providing a road itinerary recommendation service to users connected to said application server from communication terminals TC.

The application server SA comprises a recommendation module REC and an optimization module OPT. In the remainder of the description, the term module may designate a device, a software program, or a combination of computer hardware and software, configured to execute at least one particular task.

The recommendation module REC retrieves information about various users, and particularly a profile for each user.

In his or her profile, the user indicates, for example, the starting or arrival date, and the starting or arrival location. The user may further impose constraints such as an itinerary without tolls, or without major highways, or the shortest or fastest itinerary. The user may further impose constraints on the type of vehicle used, which may, for example, be a motor vehicle or non-motor vehicle, with two, three, or four wheels. It is assumed that the departure or arrival date may be specified in days, hours, and minutes.

The recommendation module REC further retrieves information about the state of road traffic, such as the current road congestion situation and road congestion forecasts assisted by statistics and historical data.

The recommendation module REC may further retrieve information about the weather, such as the current weather and weather forecasts, and information about the state of the roads, which may be dry, wet, or slippery, for example.

The recommendation module REC provides an itinerary recommended to the user based on the user's profile, particularly containing the departure or arrival date, the departure location or arrival location, and additionally, based on information retrieval regarding the state of road traffic or the state of the roads.

The optimization module OPT compares the itineraries recommended to users whose indicated departure date belongs to a given interval time. The optimization module OPT produces a set of users whose corresponding recommended itineraries have at least one itinerary segment of given length in common. Said itinerary segment is determined based on information retrieved by the recommendation module REC, such as information about the state of road traffic and the state of the roads. It is a further feature of said segment to comprise road portions that have a risk of being congested with road traffic, particularly after the users are grouped together. The grouping of users makes it possible to tell how many users might be included together on an itinerary segment, in order to verify whether the segment might be congested or not. The risk that an itinerary segment might be congested may therefore be defined based on the number of users plan on that segment and based on the road congestion forecasts assisted by statistics and historical data. It is assumed that said set of users contains a minimum number of users whose compared recommended itineraries have an itinerary segment with a minimum length in common.

The optimization module OPT modifies, if warranted, an itinerary recommended to at least one user belonging to said set of users. The recommended itinerary may therefore be modified by changing the departure date or by changing at least one segment of the itinerary, i.e. a road portion. The recommended itinerary may further be modified based on the user's preferences and constraints.

Optionally, users may indicate their actual departure date, for example by sending a message to the application server SA from their communication terminal TC. According to one embodiment, an application may be installed in the communication terminal TC which is, for example, a "smartphone" mobile telephone that automatically communicates the departure date to the application server, using a means of geolocation and which further communicates the user's current geographic position. The application server SA may then take this information into account in order to update the recommended itineraries and said sets of users. The optimization module OPT may also take into account a user who did not follow the recommended itinerary with the departure date.

The optimization module OPT can also identify any bottlenecks following the grouping of the users on an itinerary segment and based on additional information on the state of road traffic.

The optimization module OPT thereby dynamically produces sets of users whose corresponding recommended itineraries have at least one itinerary segment of given length in common, and that take into account in real time the information provided by users and retrieved about the users.

With reference to FIG. 2, a method for optimizing road traffic according to one embodiment of the invention comprises steps E1 to E5 executed automatically within the communication system.

In step E1, a user connects to the application server SA from a communication terminal TC. The user is invited to fill out a profile, indicating the desired departure or arrival date, the departure location and arrival location, and additionally indicating constraints such as an itinerary without tolls, or without major highways, or the shortest or fastest itinerary.

In step E2, the recommendation module REC of the application server SA provides an itinerary recommended to the user based on the user's profile.

Steps E1 and E2 are thereby followed for each of the users who connect to the application server SA.

In step E3, the optimization module OPT of the application server SA compares itineraries recommended to various users whose indicated departure date belongs to a given interval of time.

In step E4, the optimization module OPT produces a set of users whose corresponding recommended itineraries have at least one itinerary segment of given length in common. Said itinerary segment has the feature of comprising road portions that have a risk of being congested with road traffic, and is additionally determined based on information retrieved by the application server regarding the state of road traffic and/or the state of the roads.

The optimization module OPT thereby seeks to find at least one road portion that has a minimum length which is subject to bottlenecks and thereby determines said set of uses so that it contains a minimum number of users who planned to take that road portion.

In step E5, the optimization module OPT modifies an itinerary recommended to at least one user who belongs to said set of users, the recommended itinerary being modified by changing the departure date or by changing at least one itinerary segment. Thus, by modifying several recommended itineraries, the application server SA reduces the risks of road traffic congestion for the itineraries recommended to users. The user may be selected for an itinerary modified based on his or her preferences and constraints.

The invention described here pertains to a method and server for optimizing road traffic. According to one embodiment of the invention, the steps of the inventive method are determined by the instructions of a computer program incorporated into a server, such as the application server SA. The program comprises program instructions that, when said program is loaded and executed within the server, carry out the steps of the inventive method. According to another implementation of the invention, the steps of the inventive method are determined by the instructions of a computer program partially incorporated into a server of a server network. The program comprises program instructions, which when said program is loaded and executed at least partially in at least one server of the server network, carry out the steps of the inventive method. In this embodiment, each server of the server network has features similar to those of the application server SA.

Consequently, the invention also applies to a computer program, particularly a computer program on or within an information medium, suitable to implement the invention. This program may use any programming language, and be in the form of source code, object code, or intermediate code between source code and object code, such as in a partially compiled form, or in any other form desirable for implementing the inventive method.

The invention claimed is:

1. A method for modifying an itinerary recommended by an application server providing recommended itineraries to users connected to said application server from communication terminals, each recommended itinerary being provided to a user based on a user profile containing the departure or arrival date, and the departure and arrival location, comprises the following within the application server:

comparing the itineraries recommended to users whose starting date belongs to a given interval of time, producing a set of users whose compared recommended itineraries have at least one itinerary segment of given length in common, identifying potential congestion of one or more road segments after users are grouped into the set of users;

modifying an itinerary recommended to at least one user belonging to said set of users, wherein the modifying takes into account one or more users in said set of users who did not follow a recommended itinerary and departure date, and wherein the modifying is performed as a function of the identified potential road congestion caused by the set of users, road congestion forecasts and statistics, and historical road congestion in order to reduce the identified potential road congestion caused by the set of users; and transmitting a modified itinerary to a communication terminal of the at least one user for display to the user;

whereby said set of users contains a minimum number of users whose compared recommended itineraries have an itinerary segment with a minimum length in common; and whereby the recommended itinerary is modified by changing the departure date.

2. A method according to claim 1, whereby said itinerary segment also has the feature of comprising road portions that have a risk of being congested with road traffic.

3. A method according to claim 1, whereby said itinerary segment is determined based on information retrieved by the application server regarding the state of road traffic and the state of the roads.

4. A method according to claim 1, whereby the recommended itinerary is modified by changing at least one segment of the itinerary.

5. A method according to claim 1, whereby the recommended itinerary is modified based on preferences and constraints related to the user's profile.

6. A method according to claim 1, whereby the itineraries recommended to users are updated by the application server based on at least one actual departure date indicated by a user.

7. The method according to claim 1, wherein changing the departure date comprises delaying the departure date.

8. An application server that modifies recommended itineraries to users connected to said application server from communication terminals, each recommended itinerary being provided to a user based on a profile of the user containing the departure date or arrival date, the departure location or arrival location, the application server comprising:

a processor programmed to:

compare the itineraries recommended to the users whose departure date belongs to a given interval of time, produce a set of users whose compared recommended itineraries have at least one itinerary segment of given length in common, identify potential congestion of one or more road segments after users are grouped into the set of users;

modify an itinerary recommended to at least one user belonging to said set of users, wherein the modifying takes into account one or more users in said set of users who did not follow a recommended itinerary and departure date, wherein the modifying is performed as a function of the identified potential road congestion caused by the set of users, road congestion forecasts and statistics, and historical road congestion in order to reduce the identified potential road congestion caused by the set of users; and transmit a modified itinerary to a communication terminal of the at least one user for display to the user;

whereby said set of users contains a minimum number of users whose compared recommended itineraries have an itinerary segment with a minimum length in common; and whereby the recommended itinerary is modified by changing the departure date.

9. A computer program capable of being implemented within an application server to optimize road traffic, said application server modify itineraries recommended to users connected to said application server from communication terminals, each recommended itinerary being provided to a user based on a profile of the user containing the departure date or arrival date, the departure location and the arrival location, said program comprising instructions which, when the program is loaded and executed within said application server, carry out the following:

comparing the itineraries recommended to users whose starting date belongs to a given interval of time, producing a set of users whose compared recommended itineraries have at least one itinerary segment of given length in common, identifying potential congestion of one or more road segments after users are grouped into the set of users;

modifying an itinerary recommended to at least one user belonging to said set of users, wherein the modifying takes into account one or more users in said set of users who did not follow a recommended itinerary and departure date, wherein the modifying is performed as a function of the identified potential road congestion caused by the set of users, road congestion forecasts and statistics, and historical road congestion in order to reduce the identified potential road congestion caused by the set of users; and transmitting a modified itinerary to a communication terminal of the at least one user for display to the user;

whereby said set of users contains a minimum number of users whose compared recommended itineraries have an itinerary segment with a minimum length in common; and whereby the recommended itinerary is modified by changing the departure date.

10. A computer program for modifying recommended itineraries via a server network providing itineraries recommended to users connected at least to a server of the server network from communication terminals, each recommended itinerary being provided to a user based on a profile of the user containing the departure or arrival date, the departure location and arrival location, said program comprising instructions that, when the program is loaded and executed at least partially in at least one server of the server network, carry out the following:

comparing the itineraries recommended to users whose starting date belongs to a given interval of time, producing a set of users whose compared recommended itineraries have at least one itinerary segment of given length in common, identifying potential congestion of one or more road segments after users are grouped into the set of users;

modifying an itinerary recommended to at least one user belonging to said set of users, wherein the modifying takes into account one or more users in said set of users who did not follow a recommended itinerary and departure date, wherein the modifying is performed as a function of the identified potential road congestion caused by the set of users, road congestion forecasts and statistics, and historical road congestion in order to reduce the identified potential road congestion caused by the set of users; and transmitting a modified itinerary to a communication terminal of the at least one user for display to the user;

whereby said set of users contains a minimum number of users whose compared recommended itineraries have an itinerary segment with a minimum length in common; and whereby the recommended itinerary is modified by changing the departure date.

* * * * *